United States Patent [19]

Koike

[11] 4,196,011

[45] Apr. 1, 1980

[54] SELF-HARDENING WATER-SOLUBLE MOLD AND PROCESS FOR PRODUCING THE SAME

[75] Inventor: Keiichi Koike, Matsudo, Japan

[73] Assignee: Hitachi, Ltd., Japan

[21] Appl. No.: 819,055

[22] Filed: Jul. 26, 1977

[30] Foreign Application Priority Data

Jul. 28, 1976 [JP] Japan ..... 51/89124
Jul. 28, 1976 [JP] Japan ..... 51/89125

[51] Int. Cl.[2] ..... B28B 7/36

[52] U.S. Cl. ..... 106/38.2; 106/38.3; 106/38.35; 106/38.9; 106/65; 106/69

[58] Field of Search ..... 106/38.3, 38.35, 38.9, 106/65, 69, 85, 38.2; 164/36, 132

[56] References Cited

U.S. PATENT DOCUMENTS

| | | | |
|---|---|---|---|
| 1,507,379 | 9/1924 | Hoskins | 106/85 |
| 1,682,675 | 8/1928 | Horsfield | 106/65 |
| 1,751,482 | 3/1930 | Leasman | 106/38.9 |
| 1,802,946 | 4/1931 | Hoy | 106/38.9 |
| 1,902,419 | 3/1933 | Plant et al. | 106/38.9 |
| 2,120,338 | 6/1938 | McDougal et al. | 106/65 |
| 2,247,588 | 7/1941 | Neiman | 106/38.3 |
| 2,345,211 | 3/1944 | Neiman | 106/38.3 |
| 2,380,945 | 8/1945 | Collins | 106/38.3 |
| 2,383,812 | 8/1945 | Navias | 106/38.3 |
| 2,479,504 | 8/1949 | Moore et al. | 106/38.9 |
| 2,522,548 | 9/1950 | Streicher | 106/38.9 |
| 2,702,425 | 2/1955 | Thompson | 106/286 |
| 2,895,838 | 7/1959 | Ilenda | 106/38.3 |
| 2,926,098 | 2/1960 | Ilenda et al. | 106/38.35 |
| 3,032,425 | 5/1962 | Leach | 106/38.9 |
| 3,468,719 | 9/1969 | Tennenhouse | 106/65 |
| 3,910,798 | 10/1975 | Shires et al. | 106/38.9 |
| 4,070,195 | 1/1978 | Toeniskoetter et al. | 106/38.9 |
| 4,093,017 | 6/1978 | Miller et al. | 106/38.9 |

*Primary Examiner*—Lorenzo B. Hayes
*Attorney, Agent, or Firm*—Craig and Antonelli

[57] ABSTRACT

A mold produced by adding to a molding material consisting mainly of alumina a binder prepared by adding an inorganic water-soluble substance to an alcohol or a mixture of an alcohol and water, kneading and molding the mixture, and then drying the molded mixture has water-solubility and self-hardening property. Further, by suitable selection and combination of the inorganic water-soluble substance and the solvent in the binder, the drying step becomes unnecessary or the molding material shows fluidity at room temperature and a self-hardening water-soluble mold requiring no ramming is obtained.

10 Claims, No Drawings

SELF-HARDENING WATER-SOLUBLE MOLD AND PROCESS FOR PRODUCING THE SAME

LIST OF PRIOR ART (37 CFR 1.56(a))

The following references are cited to show the state of the art: Japanese Pat. Nos. 816,642; 816,643.

BACKGROUND OF THE INVENTION

The present invention relates to a self-hardening water-soluble mold and a process for producing the same.

Prior art water-soluble molds can be removed from the casting by dissolving or decomposing with water, but the removing speed has not necessarily been great. The mold comprising alumina as a main material and a water-soluble compound as a binder which was previously invented by the present inventors to solve the above-mentioned difficulty (Japanese Pat. Nos. 816,642 and 916,643) may be easily disintegrated with water and it is easy to remove the mold. However, this mold has defects in that it must be dried before casting since it contains moisture and the drying time is prolonged particularly in case of a large mold. Also, when used as an outer mold, the moisture content is high and the mold strength is not satisfactory owing to such a high moisture content. In this case, drying is still required.

Also, a process wherein an inorganic water-soluble substance, hydrate of which is stable at room temperature, and water are added to alumina, the mixture is heated to a temperature of 100° C. or less to dissolve said water-soluble substance in its water of crystallization and thereby fluidize the whole mixture, the fluidized mixture is poured into a pattern and cooled to solidify the mixture, and the resulting molded article is dried and used as a mold for casting metals, was previously invented by the present inventors and is now known. However, this process has a defect that narrow spaces of the pattern cannot be filled by the fluidized mixture owing to a reduction in fluidity with a decrease in temperature when the fluidized mixture is poured into the pattern.

SUMMARY OF THE INVENTION

An object of the present invention is to provide a water-soluble and self-hardening mold requiring no drying step.

Another object of the invention is to provide a self-hardening water-soluble mold showing fluidity at room temperature by suitable selection and combination of an inorganic water-soluble substance and a solvent in a binder.

The other objects and advantages of the present invention will be apparent from the following description.

According to the present invention, a self-hardening water-soluble mold comprising alumina as a main material and an inorganic water-soluble substance is provided. Thus, the self-hardening water-soluble mold of the present invention comprises alumina as a main material and an inorganic water-soluble substance as a binder such as a carbonate, chloride or phosphate or an oxide or hydroxide of an alkali metal or alkaline earth metal. By controlling the amount of an alcohol or a mixture of an alcohol and water used as a solvent for a binder, the self-hardening water-soluble mold can spare a drying step or the molding material shows fluidity at room temperature. Therefore, a self-hardening water-soluble mold requiring no ramming can be obtained. The molding material used can be used repeatedly since no binder is accumulated after use.

EMBODIMENTS OF THE INVENTION

First of all, a mold requiring no forced drying will be explained.

The mold can be obtained by dissolving or dispersing an inorganic water-soluble substance in an alcohol (a polyhydric alcohol and/or a monohydric alcohol), adding the resulting solution or dispersion alone or in admixture with a small amount of water to alumina, and then molding the mixture by ramming or compressing. This mold has a low moisture content and self-hardening property. Thereby, it can be used as a mold for casting metals without forced drying or after slight surface drying for increasing the mold strength.

At temperatures from room temperature to the boiling point of the alcohol added, the strength of the mold is maintained by the binding force of the solution of the water-soluble compound in the alcohol. At temperatures of higher than the boiling point of the alcohol added, the alcohol evaporates but the strength of the mold is maintained by the binding strength of the remaining inorganic water-soluble compound.

Since the alcohol and the inorganic water-soluble compound are all water-soluble, the mold can be easily disintegrated and removed from the casting by flooding the mold with water, for example, by a hose or by dipping the casting in water after casting.

In case of this water-soluble mold, a water-soluble mold comprising alumina and a water-soluble compound which has heretofore contained a large amount of moisture and required drying comes to contain no moisture or a small amount, about 1 to 2% by weight, of moisture and to be usuable as a mold without drying. Also, the moisture contained in the mold is not fixed in the form of water of crystallization of the inorganic water-soluble compound (for example, $K_3PO_4$, $KA10_2$, etc.) owing to the presence of the alcohol. It is effective for increasing the fluidity of the molding material at room temperature and preventing the deformation of the mold at high temperatures.

As the water-soluble compound added as a binder in a molding material for this mold, any inorganic water-soluble compound may be used so long as it is alcohol-soluble or alcohol-dispersible. Examples thereof are shown in the following table together with the main material and the alcohol.

The term "dispersible" used herein means that the water-soluble compound forms a complex compound with the alcohol and the complex compound is dispersed in the alcohol.

EXAMPLES OF MOLDING MATERIAL

Examples of Molding Material

| Main material | Inorganic water-soluble compound | Alcohol | Use |
|---|---|---|---|
| $Al_2O_3$ | NaCl<br>KCl<br>$CaCl_2$<br>$Na_2CO_3$<br>$K_2CO_3$ | Monohydric alcohol (Ethyl alcohol) Polyhydric alcohol (Sorbitol, glycerol, ethylene (glycol, etc.) | Aluminum alloy |
| $Al_2O_3$ | $Na_3PO_4$<br>$K_3PO_4$ | | Copper alloy, cast iron, aluminum alloy |

-continued

| Examples of Molding Material | | | |
|---|---|---|---|
| Main material | Inorganic water-soluble compound | Alcohol | Use |
| $Al_2O_3$ | $NaAlO_2$<br>$KAlO_2$<br>$Li_2O$<br>BaO<br>SrO<br>LiOH<br>$Ba(OH)_2$<br>$Sr(OH)_2$<br>$BaAl_2O_4$ | | Cast steel, copper alloy, cast iron, aluminum alloy |

Note: To 100 parts by weight of an inorganic water-soluble compound is added 60 to 200 parts by weight of a mixture consisting of 2 to 50% by weight of a polyhydric alcohol (ethylene glycol, etc.), 0 to 60% by weight of a monohydric alcohol (ethyl alcohol, etc.) and 0 to 88% by weight of water, and 2 to 40 parts by weight of the binder thus obtained is then added to 100 parts by weight of alumina.

Also, these inorganic water-soluble compounds may be used in the form of a mixture of two or more thereof.

Next, a self-hardening water-soluble mold which requires slight drying but requires no ramming owing to the fluidity of the molding material will be explained below.

The fluid water-soluble mold of the present invention utilizes the hydration reaction of an inorganic water-soluble substance for fluid molding of a water-soluble mold. Thus, alumina is added to a solution of an inorganic water-soluble substance in an alcohol, and water is then added to form a slurry. Hydration reaction proceeds gradually in this state and the slurry is gradually solidified. In this case, solidification time or hardening time can be changed or controlled according to the time of pouring the slurry into a pattern and before solidification in the pattern and the time of removing the mold from the pattern by controlling the amounts of the alcohol and water added. Further, this process has advantages in that molds of a complicated and fine shape can be correctly produced, and the moisture content of the mold can be reduced, whereby drying operation being facilitated and drying time being shortened.

The inorganic water-soluble substance used in this mold, a hydrate of which is stable at room temperature, is exemplified by $Na_2CO_3.10H_2O$, $Na_3PO_4.12H_2O$, $Ba(OH)_2.8H_2O$ and $Al_2(SO_4)_3.18H_2O$. These compounds have a high melting point, are stable at the melting temperature of metals after dehydration, and are comparatively large in the amount of water binded as water of crystallization.

If alumina is added to a solution of these compounds in an alcohol and an amount of water to be fixed as water of crystallization or less water is then added to the mixture to form a slurry, the reactions as mentioned below occur in the mixture, water is fixed as water of crystallization of these compounds, and the slurry is solidified.

Among the inorganic water-soluble substances as mentioned in the above-mentioned table, sodium carbonate ($Na_2CO_3$), sodium phosphate ($Na_3PO_4$), barium hydroxide ($Ba(OH)_2$) and barium oxide (BaO) are suitable, and hydration reaction proceeds as follows:

$$Na_2CO_3 + 10H_2O \rightarrow Na_2CO_3.10H_2O$$

$$Na_3PO_4 + 12H_2O \rightarrow Na_3PO_4.12H_2O$$

$$Ba(OH)_2 + 8H_2O \rightarrow Ba(OH)_2.8H_2O \text{ or}$$

$$BaO + 10H_2O \rightarrow Ba(OH)_2.8H_2O + H_2$$

This reaction proceeds rapidly in water, but gradually in a mixture of an alcohol and water. Thereby, hardening time can be controlled by varying a ratio of water to the alcohol. The alcohol which is set free has no influence on solidification if its amount is small. When its amount is large, however, an alkali metal or its chloride is previously added to fix the alcohol as alcoholate of the metal.

$$Al + 3R{-}OH \rightarrow (R{-}O)_3Al + (3/2)H_2$$

wherein R is an alkyl group.

The alcohol used here is selected according to the solubility of the inorganic water-soluble compound. The above-mentioned monohydric alcohols and polyhydric alcohols may be used. Also, there may be used substances which may react with water to form an alcohol such as mono- or polyethylene oxide $\text{-}\!\!\left[CH_2CH_2O\right]_n\!\!\text{-}$, etc.

Further, if silica sand is used as a main material in place of alumina and a water-soluble compound which is not reactive with silica sand such as barium oxide, barium hydroxide, strontium oxide or strontium hydroxide is added, a water-soluble mold can be obtained. If aluminum powder or aluminum chloride is added thereto, a self-hardening water-soluble mold requiring no forced drying step can be obtained.

The following examples, in which all parts and percentages are expressed by weight unless otherwise indicated, will serve to illustrate the practice of the invention in more detail, but the invention should not be construed to be limited by the examples.

EXAMPLE 1

A binder is prepared by adding 80 parts of a mixture consisting of 10% of ethylene glycol, 60% of ethyl alcohol and 30% of water to 100 parts of potassium carbonate. 8 Parts of the binder thus prepared is then added to 100 parts of alumina particles (100 mesh) and a mold for casting of metals (a piston mold) is produced by molding of the mixture. This mold is self-hardening and is hardened only by allowing to stand, and the amount of moisture remained in the mold is very small (less than 1.2%) without drying. An aluminum alloy (AC 8A) which has been molten at 720° C. is cast by the use of this mold. The mold after casting is easily disintegrated and removed from the casting with water and a good casting can be obtained.

EXAMPLE 2

A binder is prepared by adding 80 parts of a mixture consisting of 10% of glycerol, 70% of ethyl alcohol and 20% of water to 100 parts of potassium phosphate. 10 Parts of the binder thus prepared is added to 100 parts of alumina particles (120 mesh). A mold for casting metals (a piston mold) is produced by molding of the mixture. Cast iron at 1350° C. is cast into this mold without drying. The mold after casting is easily disintegrated and removed from the casting with water, and a good casting can be obtained.

EXAMPLE 3

A binder is prepared by adding 80 parts of a mixture consisting of 10% of sorbitol, 60% of propyl alcohol and 30% of water to 100 parts of sodium aluminate. 8 Parts of the binder thus prepared is added to 100 parts of alumina particles (100 mesh). A self-hardening mold for casting metals (a cylinder mold) is produced by molding of the mixture. Cast steel at 1600° C. is cast into this mold without drying. The mold after casting is easily disintegrated and removed from the casting with water and a good casting can be obtained.

EXAMPLE 4

A binder is prepared by adding 80 parts of a mixture consisting of 10% of ethylene glycol, 60% of ethyl alcohol and 30% of water to 100 parts of anhydrous barium hydroxide. 15 Parts of the binder thus prepared is added to 100 parts of alumina particles (120 mesh). A self-hardening mold for casting metals (a cylinder mold) is produced by molding of the mixture. Cast steel at 1600° C. is cast into this mold without drying. The mold after casting is easily disintegrated and removed from the casting with water and a good casting is obtained.

EXAMPLE 5

To a mixture consisting of 80 parts of alumina, 18 parts of anhydrous barium hydroxide and 2 parts of aluminum powder are added 1.5 parts of sorbitol, 20 parts of ethyl alcohol and 15 parts of water to fluidize the mixture. The molding material thus prepared is poured into a pattern at 20° C. The material solidifies in about 10 minutes. The solidified material is then removed from the pattern and dried to obtain a mold comprising eventually alumina and barium oxide. Cast steel at 1600° C. is cast into the mold. When the casting is dipped in water, the mold is easily disintegrated and removed from the casting, and a good casting can be obtained.

EXAMPLE 6

A mold is produced in the same manner as in Example 5 except that barium hydroxide is replaced by barium oxide and only ethyl alcohol is used. Thus, a similar result to that of Example 5 is obtained.

EXAMPLE 7

To a mixture consisting of 85 parts of alumina, 13 parts of anhydrous sodium phosphate and 2 parts of aluminum powder are added 3 parts of glycerol, 25 parts of ethyl alcohol and 8 parts of water to fluidize the mixture. The molding material thus prepared is poured into a pattern at 20° C. The material solidifies in about 10 minutes. The solidified material is then removed from the pattern and dried to obtain a mold. Cast iron at 1350° C. is cast into the mold. When the casting is flooded with water, the mold is easily disintegrated and removed from the casting and a good casting can be obtained.

EXAMPLE 8

To a mixture consisting of 90 parts of alumina, 8 parts of sodium carbonate and 2 parts of aluminum powder are added 1 part of ethylene glycol, 27 parts of ethyl alcohol and 5 parts of water to fluidize the mixture. When the molding material thus prepared is poured into a pattern at 20° C., the material solidifies in about 10 minutes. The solidified material is then removed from the pattern and dried to obtain a mold. An aluminum alloy (AC 4A) at 720° C. is cast into the mold. When the casting is flooded with water, the mold is easily disintegrated and removed from the casting and a good casting can be obtained.

EXAMPLE 9

A mold is produced in the same manner as in Example 8 except that aluminum powder is replaced by 2 parts of anhydrous aluminum chloride. Thus, a similar result to that of Example 8 is obtained.

EXAMPLE 10

To a mold material obtained by adding 92.5 parts of silica sand, 5 parts of barium hydroxide, 2.5 parts of sorbitol and 5 parts of water is added 2 parts of aluminum powder. The mixture is kneaded and filled into a pattern for producing a core having a diameter of 50 mm and a height of 50 mm. The molded article hardens in 30 minutes. Cast iron at 1350° C. is cast by the use of the core thus prepared. The mold after casting is easily disintegrated and removed from the casting with water.

What is claimed is:

1. A self-hardening water-soluble mold consisting essentially of alumina as a main material and one carbonate selected from the group consisting of sodium carbonate and potassium carbonate as a water-soluble binder, whereby the mold can be easily disintegrated and removed from a casting with water.

2. A self-hardening water-soluble mold consisting essentially of alumina as a main material and one chloride selected from the group consisting of sodium chloride, potassium chloride, magnesium chloride and lithium chloride as a water-soluble binder, whereby the mold can be easily disintegrated and removed from a casting with water.

3. A self-hardening water-soluble mold consisting essentially of alumina as a main material and one phosphate selected from the group consisting of sodium phosphate and potassium phosphate as a water-soluble binder, whereby the mold can be easily disintegrated and removed from a casting with water.

4. A self-hardening water-soluble mold consisting essentially of alumina as a main material and one oxide or hydroxide of an alkali metal or alkaline earth metal selected from the group consisting of barium hydroxide, strontium hydroxide, potassium aluminate and lithium hydroxide as a water-soluble binder, whereby the mold can be easily disintegrated and removed from a casting with water.

5. A self-hardening water-soluble mold consisting essentially of alumina as a main material and at least two members selected from the group consisting of sodium phosphate, potassium phosphate, sodium aluminate, potassium aluminate and lithium hydroxide as a water-soluble binder, whereby the mold can be easily disintegrated and removed from a casting with water.

6. A self-hardening water-soluble mold consisting essentially of alumina as a main material and at least two members selected from the group consisting of barium oxide, barium hydroxide, strontium oxide, strontium hydroxide, barium aluminate, sodium aluminate, potassium aluminate and lithium hydroxide as a water-soluble binder, whereby the mold can be easily disintegrated and removed from a casting with water.

7. A process for producing a self-hardening water soluble mold which can be easily disintegrated and removed from a casting with water which comprises forming a molding composition by adding 2 to 40 parts by weight of a mixture forming a binder to 100 parts by weight of alumina, kneading and molding the composition, and then drying the molded composition, said mixture being prepared by adding 60 to 200 parts by weight of a mixture consisting of 2 to 50% by weight of a polyhydric alcohol, 0 to 60% by weight of a monohydric alcohol, and 0 to 88% by weight of water to 100 parts by weight of an inorganic water-soluble substance selected from the group consisting of magnesium chloride, lithium chloride, sodium carbonate, potassium carbonate, potassium phosphate, barium oxide, barium hydroxide, strontium oxide, strontium hydroxide, barium aluminate, sodium aluminate, potassium aluminate and lithium hydroxide, whereby a mold consisting essentially of alumina and said inorganic water-soluble substance is formed.

8. A process according to claim 7, wherein said polyhydric alcohol is selected from the group consisting of ethylene glycol, glycerol and sorbitol.

9. A process according to claim 7, wherein said monohydric alcohol is selected from the group consisting of ethyl alcohol and propyl alcohol.

10. A process for producing a self-hardening water-soluble mold which can be easily disintegrated and removed from a casting with water which comprises forming a molding composition by adding 2 parts by weight of aluminum powder to 105 parts by weight of a mold material obtained by mixing 92.5 parts by weight of silica sand, 5 parts by weight of barium hydroxide, 2.5 parts by weight of sorbitol, and 5 parts by weight of water, and then kneading and molding the composition.

* * * * *